US010692422B2

(12) United States Patent
Yao

(10) Patent No.: US 10,692,422 B2
(45) Date of Patent: Jun. 23, 2020

(54) DRIVE CHIP, DRIVE CIRCUIT AND DRIVE METHOD CAPABLE OF ELIMINATING LED GHOST

(71) Applicant: GENESIS SYSTECH CO., LTD, Shenzhen (CN)

(72) Inventor: Ruikun Yao, Shenzhen (CN)

(73) Assignee: GENESIS SYSTECH CO., LTD., Shenzhen (CN)

( * ) Notice: Subject to any disclaimer, the term of this patent is extended or adjusted under 35 U.S.C. 154(b) by 0 days.

(21) Appl. No.: 16/307,080

(22) PCT Filed: Mar. 28, 2017

(86) PCT No.: PCT/CN2017/078442
§ 371 (c)(1),
(2) Date: Dec. 4, 2018

(87) PCT Pub. No.: WO2017/215310
PCT Pub. Date: Dec. 21, 2017

(65) Prior Publication Data

US 2019/0147795 A1 May 16, 2019

(30) Foreign Application Priority Data

Jun. 14, 2016 (CN) ..... 2016 1 0413366

(51) Int. Cl.
*G09G 3/32* (2016.01)

(52) U.S. Cl.
CPC ..... *G09G 3/32* (2013.01); *G09G 2310/0248* (2013.01); *G09G 2310/061* (2013.01);
(Continued)

(58) Field of Classification Search
CPC ..... G09G 2320/064; G09G 2320/0209; G09G 2310/061; G09G 2310/0248;
(Continued)

(56) References Cited

U.S. PATENT DOCUMENTS

2009/0309855 A1 12/2009 Wang et al.
2010/0181936 A1* 7/2010 Radermacher ..... H05B 33/0818 315/307
(Continued)

FOREIGN PATENT DOCUMENTS

CN 104091568 A 10/2014
CN 104091569 A 10/2014
(Continued)

OTHER PUBLICATIONS

Machine translation of CN105374317 (Year: 2016).*
(Continued)

*Primary Examiner* — Patrick N Edouard
*Assistant Examiner* — Joseph P Fox
(74) *Attorney, Agent, or Firm* — Anova Law Group, PLLC

(57) ABSTRACT

Disclosed are drive chip, drive circuit and drive method capable of eliminating LED ghost. The drive chip comprises a processing unit, a blanking unit and a constant current drive unit. By blanking unit, parasitic capacitances of each row of scanning lines of an LED array is discharged during a blanking period, eliminating an upper ghost without needing to pull down additional circuits such as a resistor, no caterpillar effect or the reverse bias of LED lamp beads; charging parasitic capacitance of each column of scanning lines of the LED array, eliminating lower ghost. By constant current drive unit, constant current control is performed on LED lamp beads. Performing blanking and constant current control individually in two time periods, when displaying LED lamp beads, parasitic capacitance and both upper and lower ghosts are eliminated.

10 Claims, 4 Drawing Sheets

(52) U.S. Cl.
CPC ..... *G09G 2320/0209* (2013.01); *G09G 2320/064* (2013.01)

(58) Field of Classification Search
CPC ..... G09G 2320/0257; G09G 3/32; H05B 33/083; H05B 33/0827
See application file for complete search history.

(56) References Cited

U.S. PATENT DOCUMENTS

| | | | | |
|---|---|---|---|---|
| 2012/0176062 | A1* | 7/2012 | Sato ..... | H05B 33/0827 315/294 |
| 2013/0278151 | A1* | 10/2013 | Lear ..... | H05B 33/0815 315/164 |

FOREIGN PATENT DOCUMENTS

| | | | |
|---|---|---|---|
| CN | 105374317 | A | 3/2016 |
| CN | 105632399 | A | 6/2016 |
| CN | 105938703 | A | 9/2016 |
| CN | 205692548 | U | 11/2016 |

OTHER PUBLICATIONS

The World Intellectual Property Organization (WIPO) International Search Report for PCT/CN2017/078442 dated Jun. 7, 2017 6 Pages.

* cited by examiner

DRIVE CHIP, DRIVE CIRCUIT AND DRIVE METHOD CAPABLE OF ELIMINATING LED GHOST

CROSS-REFERENCES TO RELATED APPLICATIONS

This application is a national stage application of PCT Patent Application No. PCT/CN 2017/078442, filed on 28 Mar. 2017, which claims priority to Chinese Patent Application No. 201610413366.0, filed on 14 Jun. 2016, the content of all of which is incorporated herein by reference.

FIELD OF THE INVENTION

The present invention relates to the field of an LED control chip technology, and more particularly, to a drive chip, a drive circuit and a drive method capable of eliminating an LED ghost.

BACKGROUND

When a single-point brightness pattern is on presenting, an LED display scheme will appear a plurality of slightly bright points around the single-point, which is commonly known as a ghost. A reason of a ghost generation is, there is a plurality of Cp and Cn parasitic capacitances on a row and a column of a plurality of scanning lines on a PCB, when a system is switching a state, an incorrect voltage of the Cp and Cn may cause a leakage current generating, while a plurality of LEDs around the bright spot may further generate an abnormal light leakage.

Referencing to FIG. 1, the ghost may be divided into an upper ghost and a lower ghost, a mechanism of generating the ghost is as follows:

State 1: when a first row of the scanning lines COM1 finishes displaying, a parasitic capacitance Cp1 of the first row of the scanning lines is charged by a transistor of P1 and kept in a high voltage. When a next line COM2 (a second row of the scanning lines) starts, if a SEG2 lights up a Q22, then a plurality of charges of the parasitic capacitance Cp1 in the first row of the scanning lines will be discharged by the SEG2 through a Q12, thus generating a light leakage from the Q12, called an upper ghost.

State2: The Q22 is lit up, when the COM2 finishes displaying, a parasitic capacitance Cn2 of a second column of the scanning lines is discharged by a transistor of N2 and kept in a low voltage, and at a short time of turning on a COM3, a current charges and lifts the voltage of Cn2 from a P3 through a Q32, thus generating a light leakage from the Q32, called a lower ghost. Wherein from Q11 to Q33, all are light emitting diodes.

All above, the ghosts are all generated by a plurality of abnormal voltages from the parasitic capacitances in the system, thus, an appropriate bias voltage helps to eliminate a phenomenon of the ghost.

In the industry, improving the lower ghosts is currently achieved by pulling high a voltage of a SEG terminal via a column constant current drive chip before switching a COM line to keep the parasitic capacitances Cn of the columns of the scanning lines in a high voltage, keeping no current from charging the Cn when switching between the COM lines, therefore eliminating the lower ghosts.

According to a problem of the upper ghosts, when designing a circuit for an LED displayer, a process of discharging the rows of the scanning lines will be made, that is, a blanking circuit will be added. And in the present arts, a blanking circuit has a plurality of schemes as listed below:

1. pull down a ground resistance;
2. a Zener diode+a pull-down resistance.

Currently, on a market, all solutions of eliminating the upper ghost are achieved by discharging the rows of the scanning lines, which needs to add a plurality of additional circuits, causing a plurality of problems including a caterpillar effect and a reverse bias voltage of an LED lamp bead.

Specifically, the scheme 1 has a plurality of characters including a low cost and a convenience, however, to a plurality of rows of the scanning lines, it may have a constant pull-down current, generating a pretty large reverse bias voltage to the LED lamp beads and having a caterpillar phenomenon exist. The scheme 2 suppresses the rows of the scanning lines to 3.3V, without any caterpillar effects, however, it may still generate a pretty large reverse bias voltage to the LED lamp beads, and the scheme has a plurality of components.

Therefore, the current technology needs to be improved and developed.

BRIEF SUMMARY OF THE DISCLOSURE

According to the above described defects, the purpose of the present invention is providing a drive chip, a drive circuit and a drive method capable of eliminating an LED ghost, eliminating both the upper ghosts and the lower ghosts by a drive chip, without needing any additional circuits including the pull-down resistance and more.

In order to achieve the above mentioned goals, the technical solution of the present invention to solve the technical problems is as follows:

A drive chip capable of eliminating an LED ghost, wherein the drive chip comprises: a processing unit having a display cycle arranged, the display cycle comprises a blanking period and a PWM output period; the processing unit is applied to outputting a blanking control signal to a blanking unit during the blanking period, and sending a PWM signal to a constant current drive unit according to a display data during the PWM output period;

a blanking unit, applied to discharging a plurality of parasitic capacitances in each row of the scanning lines in an LED array during the blanking period, and charging a plurality of parasitic capacitances in each column of the scanning lines in the LED array, according to the blanking control signal;

a constant current drive unit, applied to controlling a brightness of the LED lamp beads during the PWM output period, according to the PWM signals.

The drive chip capable of eliminating the LED ghost, wherein the blanking period comprises a first period and a second period, an output terminal of the blanking unit connects to each column of the scanning lines of the LED array; the blanking unit is applied specifically to outputting a first voltage to each column of the scanning lines during the first period; and outputting a second voltage to each column of the scanning lines during the second period.

The drive chip capable of eliminating the LED ghost, wherein the first voltage is higher than the second voltage.

The drive chip capable of eliminating the LED ghost, wherein the second voltage is higher than a difference between a power source voltage and a conduct voltage of the LED lamp beads.

The drive chip capable of eliminating the LED ghost, wherein the blanking period is a PWM output period gap between each pair of two lines in the LED array.

The drive chip capable of eliminating the LED ghost, wherein a parasitic capacitance of the LED lamp bead is larger than the parasitic capacitance of the row of the scanning lines.

A drive circuit capable of eliminating the LED ghost, comprising the drive chip described above, wherein the drive circuit further comprises:

a power source, applied to supplying power to the drive circuit;

an LED array, composed by a plurality of LED lamp beads;

a master module, applied to outputting a display data to the drive chip, and driving progressively the row of the scanning lines of the LED array through a row switch module;

the switch module, applied to controlling a switch between the row of the scanning lines of the LED array and the power source, according to a control signal from the master module.

The drive circuit capable of eliminating the LED ghost, wherein the power source connects to the row of the scanning lines of the LED array through the switch module, a row control terminal of the master module connects to a control signal input terminal of the switch module, a data output terminal of the master module connects to an input terminal of the drive chip, an output terminal of the drive chip connects to the column of the scanning lines of the LED array.

The drive circuit capable of eliminating the LED ghost, wherein the master module comprises:

a master unit, applied to outputting the control signal to a code translation drive circuit, and outputting the display data to the drive chip;

a code translation drive circuit, applied to translating the control signal, and controlling the switch module drive the row of the scanning lines of the LED array according to a translated signal.

A drive method capable of eliminating the LED ghost, wherein the drive method comprises a plurality of following steps:

A. dividing a display cycle of the LED array into a blanking period and a PWM output period;

B. discharging the parasitic capacitances in each row of the scanning lines in the LED array, and charging the parasitic capacitances in each column of the scanning lines in the LED array during the blanking period;

C. controlling the brightness of the LED lamp beads during the PWM output period.

The drive method capable of eliminating the LED ghost, wherein the blanking period comprises a first period and a second period, the step B comprises specifically: outputting a first voltage to each of the columns of the scanning lines of the LED array during the first period; outputting a second voltage to each of the columns of the scanning lines of the LED array during the second period; the first voltage is higher than the second voltage.

Benefits: the present invention provides a drive chip, drive circuit and drive method capable of eliminating an LED ghost, wherein the drive chip comprises a processing unit, a blanking unit and a constant current drive unit. By means of the blanking unit, the present invention discharges a parasitic capacitance of each row of the scanning lines of an LED array during a blanking period, to eliminate an upper ghost, without needing any additional circuits such as a pull-down resistor, and having no problem including a caterpillar effect and a reverse bias voltage of a plurality of LED lamp beads. By means of a blanking unit charging a parasitic capacitance of each column of the scanning lines of an LED array, a lower ghost is eliminated. By means of a constant current drive unit constant current controlling the LED lamp beads, the present invention divides the blanking control and the constant current control into two periods to perform independently, when the LED lamp beads are in displaying, the abnormal charges in the parasitic capacitances in both rows and columns thereof have been eliminated, making the drive chip be able to eliminate both an upper ghost and a lower ghost.

DETAILED DESCRIPTION OF EMBODIMENTS

The present invention provides a drive chip, drive circuit and drive method capable of eliminating an LED ghost, in order to make the purpose, technical solution and the advantages of the present invention clearer and more explicit, further detailed descriptions of the present invention are stated here, referencing to the attached drawings and some preferred embodiments of the present invention. It should be understood that the detailed embodiments of the invention described here are used to explain the present invention only, instead of limiting the present invention.

Figure 1:
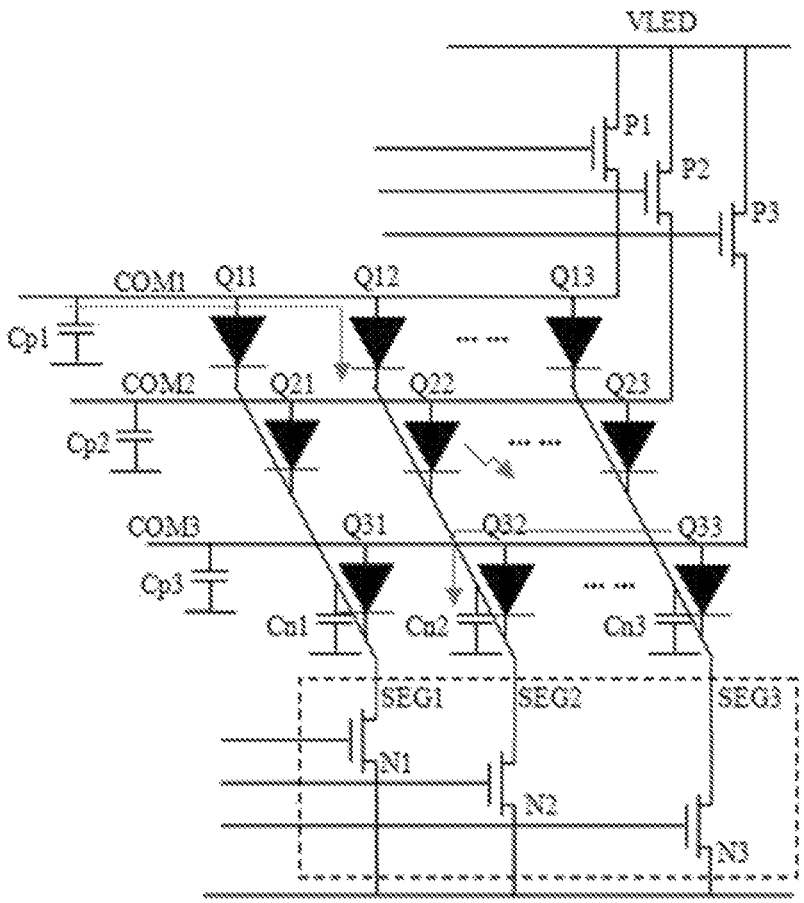
FIG. 1 (PRIOR ART)
FIG. 1 illustrates a drive circuit for a current LED displayer.
Figure 2:
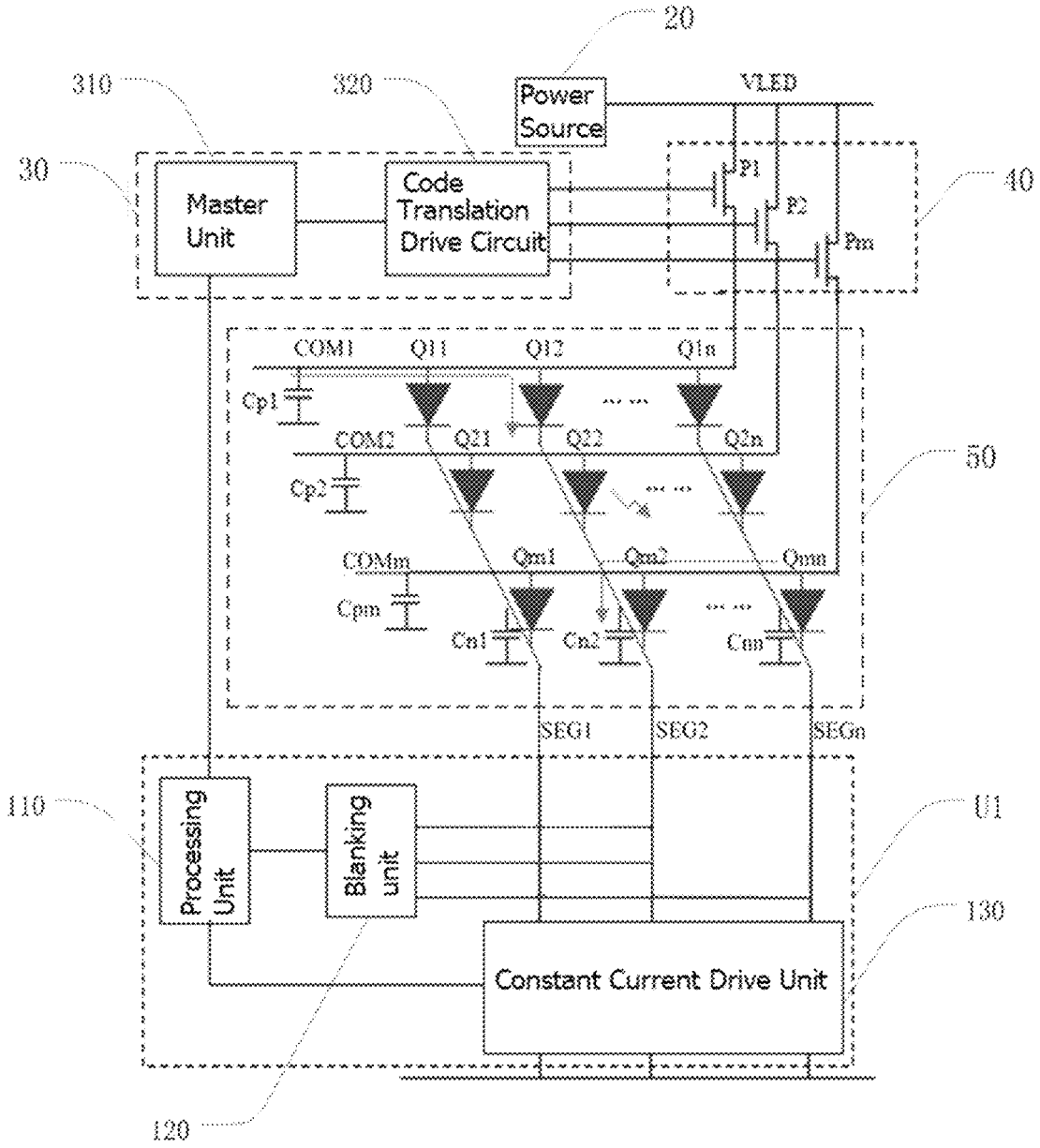
FIG. 2 illustrates a block diagram of a drive circuit capable of eliminating an LED ghost as provided in the present invention.

Referencing to FIG. 2, which is a block diagram of a preferred embodiment a drive circuit capable of eliminating an LED ghost as provided in the present invention. The drive circuit, comprise a drive chip U1, a power source 20, a master module 30, a switch module 40 and an LED array 50.

The power source 20 is applied to supplying power to the drive circuit, wherein an output supply voltage thereof is VLED.

The LED array 50 is an LED displayer, composed by a plurality of LED lamp beads. In the present embodiment, the LED array 50 is an array having m rows and n columns, wherein each of both m and n is a positive integer larger than or equal to 1.

The mast module 30 is applied to outputting a display data to the drive chip U1, and driving progressively the row of the scanning lines of the LED array 50 through a row switch module 40;

The switch module 40 is applied to controlling a switch between the row of the scanning lines of the LED array 50 and the power source 20, according to a control signal from the master module 30.

The Drive chip U1 is applied to discharging a plurality of parasitic capacitances in each row of the scanning lines in the LED array 50 during an output period gap between each pair of two lines in the LED array 50, so as to eliminate an upper ghost; and at a same time of discharging the parasitic capacitances in each row of the scanning lines, the drive chip U1 charges a plurality of parasitic capacitances in each column of the scanning lines in the LED array 50, so as to eliminate a lower ghost. In the present embodiment, the drive chip U1 is a column drive chip.

The power source 20 connects to each row of the scanning lines in the LED array 50 through the switch module 40, a row control terminal of the master module 30 connects to a control signal input terminal of the switch module 40, a data output terminal of the master module 30 connects to an input terminal of the drive chip U1, an output terminal of the drive chip U1 connects to the column of the scanning lines of the LED array 50.

The present invention eliminates totally the upper ghost through adopting a method of discharging the parasitic capacitances in each row of the scanning lines through a method of a column driven line voltage control, without increasing a cost of a row line circuit. While in the present arts, it is needed to add a Zener diode and a pull-down resistor to the rows of the scanning lines. Therefore, a structure of the present invention is simpler, with a lower cost, without generating a plurality of problems including a caterpillar effect and a reverse bias voltage of an LED lamp bead; having a good compatibility. Also, the present invention eliminates the upper ghost through the column drive chip, which also owns a function of eliminating the lower ghost, while being able to achieve a pretty high constant current accuracy in a low grayscale display.

Further, the switch module 40 comprises a 4953 chip, which has a number of m PMOS transistors to drive a number of m rows of the scanning lines. That is, each row of the scanning lines is driven by a PMOS transistor. A gate of each of the number of m PMOS transistors makes up a control signal input terminal of the switch module 40, a source of each of the number of m PMOS transistors connects to an output terminal of the power source 20, a drain of each of the number of m PMOS transistors connects to a row of the scanning lines accordingly. In another word, the master module 30 outputs the control signal to control a conduction state of the corresponding PMOS transistor, so as to make a row scanning to the LED array 50.

The master module 30 comprises a master unit 310 and a code translation drive circuit 320. The master unit 310 is applied to outputting the control signal to the code translation drive circuit 320, and outputting the display data to the drive chip U1, and an enable signal thereof. A data output terminal of the master module 310 connects to an input terminal of the drive chip U1, a control signal output terminal of the master module 310 connects to an input terminal of the code translation drive circuit 320. The code translation drive circuit 320 is applied to translating the control signal, and controlling the switch module drive the row of the scanning lines of the LED array 50 according to a translated signal, in another word, outputting the translated signal to a corresponding PMOS transistor, and controlling a conduct state thereof, and achieving a row scanning to the LED array 50. An output terminal of the code translation drive circuit 320 is a row control terminal of the master module 30, and connects to the control signal input terminal of the switch module 40. Further, the drive chip U1 comprises a processing unit 110 with a display cycle arranged, a blanking unit 120 and a constant current drive unit 130. In another word, it is the processing unit 110 that controls the display cycle of the LED array, wherein the display cycle comprises a blanking period and a PWM output period. Wherein the blanking period is a PWM output time gap (scanning time gap) between every two rows in the LED array. In the present embodiment, in a display cycle, the blanking period is ahead of the PWM output time period.

The processing unit 110 is applied to outputting a blanking control signal to the blanking unit 120 during the blanking period, and sending a PWM signal to a constant current drive unit 130 according to a display data during the PWM output period. Preferably, the processing unit 110 is a processor, including an MCU and more.

The blanking unit 120 is applied to discharging a plurality of parasitic capacitances (Cp1, Cp2, . . . , Cpm) in each row of the scanning lines in the LED array 50 during the blanking period, according to the blanking control signal, and charging a plurality of parasitic capacitances (Cn1, Cn2, . . . , Cnm) in each column of the scanning lines in the LED array 50.

The constant current drive unit 130 is applied to controlling a brightness of the LED lamp beads during the PWM output period, according to the PWM signals, and achieving a constant current control of the LED lamp beads.

A blanking control terminal of the processing unit 110 connects to an input terminal of the blanking unit 120, an output terminal of the blanking unit 120 connects to each column of the scanning lines. A display data output terminal of the processing unit 110 connects to an input terminal of the constant current drive unit 130, an output terminal of the constant current drive unit 130 connects to each column of the scanning lines.

The present invention divides the blanking control and the constant current control into two periods to perform independently, when the LED lamp beads are in displaying, the parasitic capacitances in both row and column thereof have been eliminated, making the drive chip U1 be able to eliminate both an upper ghost and a lower ghost.

Further, the blanking period comprises a first period T1 and a second period T2, an output terminal of the blanking unit 120 connects (electrically connects) to each column of the scanning lines of the LED array 50; the blanking unit 120 is applied specifically to outputting a first voltage (voltage) to each column of the scanning lines during the first period, discharging the parasitic capacitances of the LED lamp beads in each column of the scanning lines; and outputting a second voltage (voltage) to each column of the scanning lines during the second period, and eliminating the upper ghost by electric sharing. Since both the first voltage and the second voltage are higher than a required voltage to turn on the LED lamp beads, thus an effect of eliminating the lower ghost is achieved at a same time. In the present embodiment, during a blanking period, the first period T1 is ahead of the second period T2. The first voltage is higher (larger) than the second voltage, that helps to the electric sharing.

Figure 3:
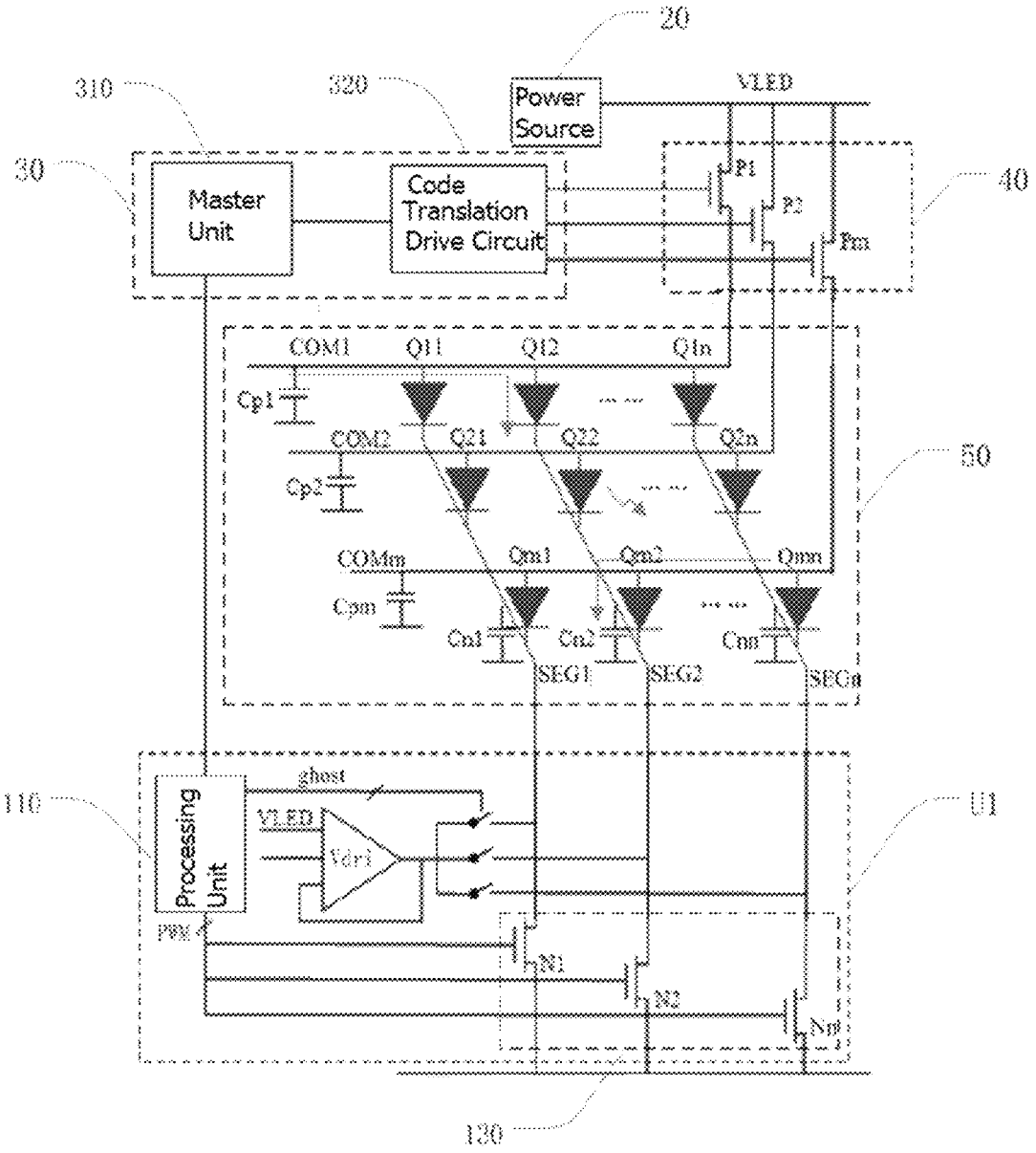
FIG. 3 illustrates a circuit diagram of a drive circuit capable of eliminating an LED ghost as provided in the present invention.

Referencing to FIG. 3, the constant current drive unit 130 comprises a number of n NMOS transistors and a number of n constant current drive circuit (not shown in the FIG.), one NMOS transistor corresponds and connects to a constant current drive circuit in serial; each NMOS transistor and the constant current drive circuit corresponds and connects to one column of the scanning lines, that is, a drain of the NMOS transistor connects to a column of the scanning lines correspondingly, a source of the NMOS transistor connects to the constant current drive circuit, a gate of the NMOS transistor becomes an input terminal of the constant current drive unit 130, and connects to a display data output terminal of the processing unit. It only needs to control an input voltage of the gate of the number of n NMOS transistors, before achieving a constant current control to the LED lamp beads in the corresponding column, that is, the NMOS transistor is a constant current drive switch, the processing unit 110 outputs the PWM signal to the corresponding NMOS transistor before achieving the constant current control to the column.

The blanking unit 120 comprises a voltage generator Vdri and a number of n switches, the voltage generator Vdri is applied to generating a first voltage and a second voltage. One end of the number of n switches connects to an output end of the voltage generator Vdri, another end of the number of n switches connects to each column of the scanning lines correspondingly, a control end of the number of n switches connects to the blanking control terminal of the processing unit 110. The number of n switches achieve an on or off according to a control of the blanking control signal.

Preferably, the first voltage is the supply voltage VLED on the row of the scanning lines, the second voltage is larger (higher) than a difference between the supply voltage VLED and a conduct voltage Vrgb of the LED lamp beads, that is, the second voltage is larger than a VLED−Vrgb, to ensure no LED light leaking happens. Since both the first voltage and the second voltage are larger than the VLED−Vrgb, thus switching the COM lines under any voltages will not generate any lower ghosts. When eliminating the upper and the lower ghosts, before a previous row of the scanning lines (take COM1 as an example) finishes scanning, a first voltage (the supply voltage VLED) is output to the column of the scanning lines, making the parasitic capacitances CL of the LED lamp beads discharge, and after the previous row of the scanning lines finishes scanning, the second voltage is output to the column of the scanning lines, pulling down the charges of the parasitic capacitances Cp in the rows of the scanning lines, and eliminating the upper ghosts. Since both the first voltage and the second voltage may finish a charging step to the parasitic capacitances Cn of the columns of the scanning lines, eliminating the lower ghosts. Therefore, the present invention adopts a capacitance charge sharing technology, by using the parasitic capacitances of the LED itself, the present invention has effectively lowered the charges of the parasitic capacitances of the rows of the scanning lines through the column drive chip, and at a same time of eliminating the ghosts, an LED display system needs no row blanking circuit added. Since the LED lamp beads in an LED displayer comprises a red light LED lamp bead, a green light LED lamp bead and a blue light LED lamp bead, thus the conduct voltage Vrgb of the LED lamp beads comprises three: a conduct voltage of the red light LED lamp bead, a conduct voltage of the green light LED lamp bead, a conduct voltage of the blue light LED lamp bead.

Therefore, the present invention integrates a function of eliminating the ghosts by adding the blanking period into a regular PWM output period, which greatly lowers an effect of the ghosts.

In an embodiment of the present invention, the blanking unit (the blanking circuit) and the constant current drive unit (constant current output circuit) are controlled by the processing unit inside the drive chip U1, and during a scanning process of the LED displayer, the blanking unit discharges the parasitic capacitance of each row of the scanning lines and charges the parasitic capacitance of each column of the scanning lines during a time gap between scanning every two lines, so as to achieve a goal of eliminating a phenomenon of the ghost effectively.

In the present invention, the master unit 310 outside outputs the control signal to make the code translation drive circuit 320 turn on a first row of the LED displayer (the LED array), now a PMOS transistor P1 is conducted, a voltage of a row COM1 of the scanning lines is pulled up to a voltage value of VLED. And at a same time, the master unit 310 outside sends the display data and an enable signal to the processing unit of the drive chip, so as to turn on the constant current drive unit to output a current to a plurality of ports from SEG1 to SEGn, and make the LED lamp beads in a first row of the LED displayer display in a preset lighting effect.

When the PWM finishes outputting a signal, the processing unit inside turns off the constant current drive unit, and makes the SEG1 to SEGn in an off state. When the blanking control signal starts (that is, the blanking period starts), the processing unit drives the blanking unit output the supply voltage VLED (the first voltage), totally discharging the parasitic capacitances of the LED lamp beads in the first row of the scanning lines, and at a same time, charging the parasitic capacitances in the columns of the scanning lines of the LED displayer to eliminate the lower ghosts. When the parasitic capacitances of the LED lamp beads in the first row of the scanning lines are totally discharged, the master unit sends a control instruction and makes the code translation drive circuit 320 turn off the first row of the LED displayer, now the PMOS transistor P1 is turned off, the processing unit drives the blanking unit Vdri output the second voltage, pulling the ports from SEG1 to SEGn to the second voltage, and sharing the charges in the parasitic capacitance of the first row of the scanning lines COM1 to a plurality of drive capacitances in the first row of the LEDs, so as to lower a voltage of the first row of the scanning lines COM1, finishing discharging the parasitic capacitances in the first row of the scanning lines of the LED displayer, and eliminating the upper ghosts; and starts a second row, now a PMOS transistor P2 is on, the voltage of the second row of the scanning lines COM2 is pulled up to the VLED, since the voltage of the SEG port is the second voltage, and the VLED—the second voltage is smaller than a conduct voltage of the LED lamp beads, thus no lower ghosts will be generated.

After finishing the display and blanking of the first row of the LEDs, the master unit outside has sent a control instruction and made the code translation drive circuit 320 turn on a second row of the LED displayer, the processing unit starts to send the display data and the blanking control signal of the second row, discharging the parasitic capacitances in each row of the scanning lines of the LED displayer, and charging the parasitic capacitances in each column of the scanning lines, according to a work process described above and in a conjunction with the master unit outside, before achieving the goal of blanking.

Figure 4:
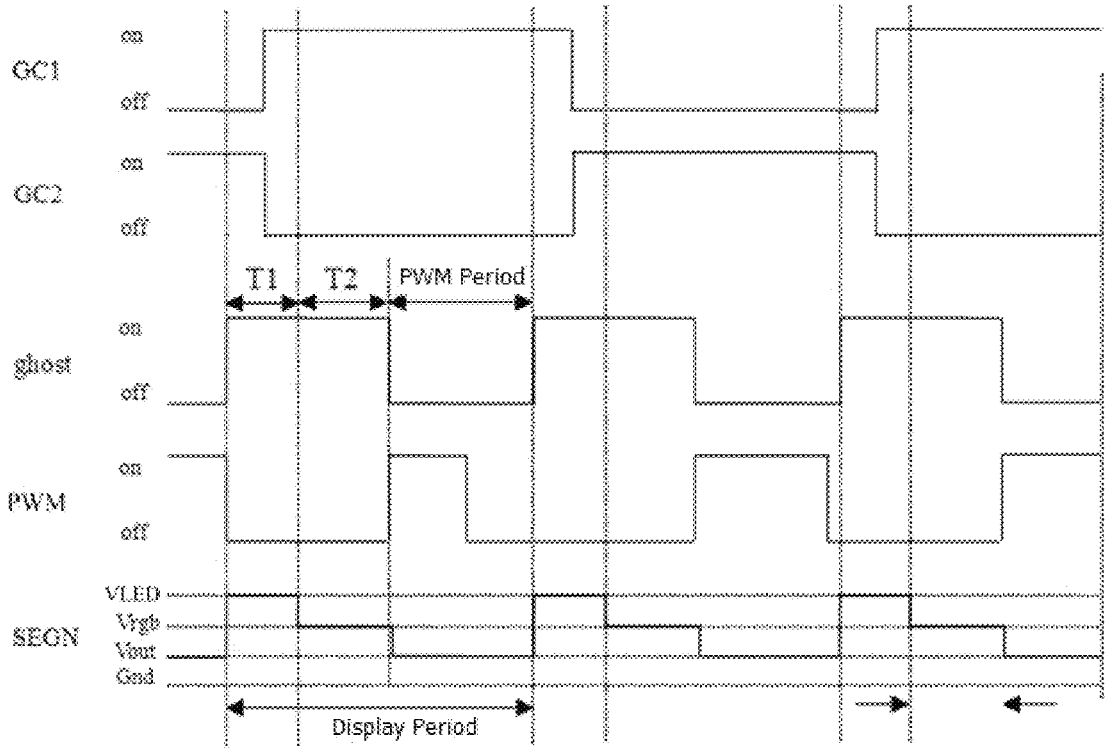
FIG. 4 illustrates a sequence diagram according to a drive circuit capable of eliminating an LED ghost as provided in the present invention.

Referencing to FIG. 4 together, which shows a sequence diagram according to the drive circuit capable of eliminating the LED ghosts, wherein GC1 is a drive signal turning on the first row of the LED displayer, GC2 is the drive signal turning on the second row of the LED displayer, both GC1 and GC2 are voltage signals to turn on one row of the LEDs in the LED displayer output by the code translation drive circuit 320 according to the instructions sent from the master unit. A ghost signal is a blanking control signal that the processing unit drives the blanking unit blank, a PWM signal is an enable signal for the constant current drive unit, a SEGN is a voltage signal on an output terminal of the drive chip.

A whole display cycle comprises a blanking period and a PWM output period, the blanking period comprises two processes of T1 and T2. During the period of T1, the PWM signal is off, the constant current output stops, now the ghost signal controls the blanking unit output a VLED voltage, the master unit outside sends a control instruction and makes the code translation circuit turn off the first row of the COM lines of the LED displayer, and turn on the second row of the COM lines, now the parasitic capacitances of the first row of the LED lamp beads are discharged totally. During the period of T2, the ghost signal controls the blanking unit output a voltage of Vrgb, and discharge the charges of the parasitic capacitances of the first row of COM lines to the parasitic capacitances of the first row of the LED lamp beads, the voltage of the first row of the COM lines goes down, and a process of ghost elimination is finished. During the PWM period (that is, the PWM output period), the processing unit of the drive chip will send the PWM signal according to the display data received from the master unit outside, and turn on the constant current output circuit before lighting the LED lamps, after finishing the display sequence, the PWM signal is off, and the constant current output unit stops outputting a current, the terminals of the SEG1 to SEGn are floating. After the PWM period ends, the circuit enters a next display cycle, and starts displaying a next row. Wherein a ratio of the first period T1 to the second period T2 is set according to a real load of the circuit.

The output terminal of the drive chip described in the present invention further adds a voltage clamp function, making a column output drive transistor not only own a constant current drive ability, also clamp an output terminal of a channel to a stable voltage according to a sequence request. The present invention provides a drive circuit, which is capable of totally eliminating both the upper ghost and the lower ghost, and improving an effect of a low grayscale constant current.

All together, the present invention provides a method of discharging the charges in the capacitances of the rows of the scanning lines through a voltage control of a column drive line, without adding a cost of any rows of a line circuit, totally eliminating the upper ghost. The drive chip may be compactable with any existing drive circuits, and an overall price is the least expensive. Since the present invention eliminates the row ghosts through a column drive chip, with a function of eliminating the column ghosts, thus it is also able to achieve a pretty high accuracy of the constant current in a low grayscale display.

Figure 5:
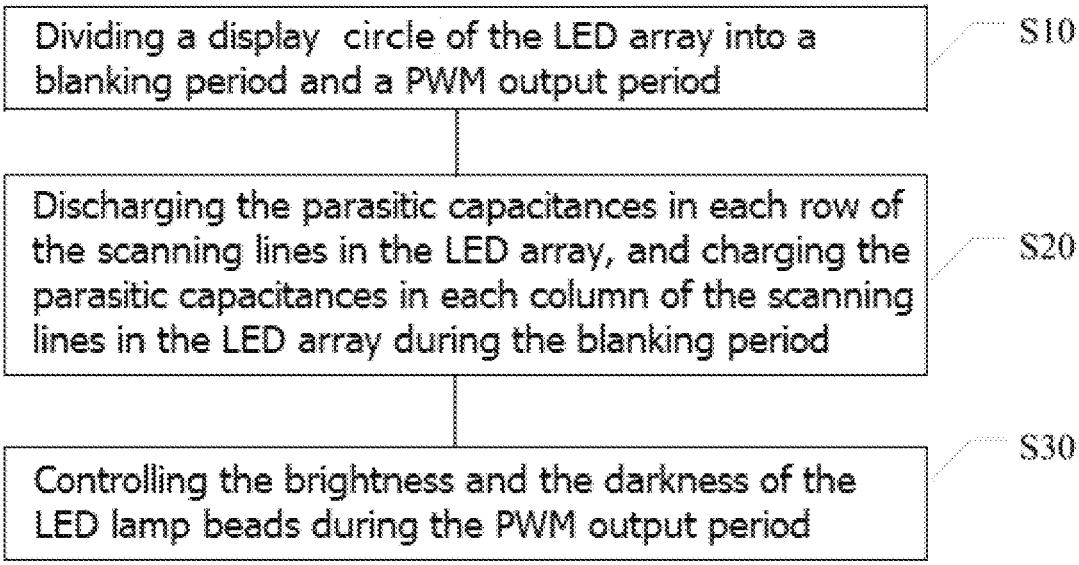
FIG. 5 illustrates a flow chart for a drive method capable of eliminating an LED ghost as provided in the present invention.

Based on the drive chip capable of eliminating the LED ghosts and the drive circuit capable of eliminating the LED ghosts provided by the embodiments described above, the present invention further provides a drive method capable of eliminating the LED ghosts, referencing to FIG. 5, the driving method comprises a plurality of following steps:

S10, Divides a display cycle of the LED array into a blanking period and a PWM output period. Specifically, preset a display cycle in a processing unit of the drive chip, the display cycle comprises a blanking period and a PWM output period. During the blanking period, the processing unit outputs a blanking control signal to the blanking unit, and sends a PWM signal to the constant current drive unit according to the display data during the PWM output period, S20. Discharges the parasitic capacitances in each row of the scanning lines in the LED array, and charges the parasitic capacitances in each column of the scanning lines in the LED array during the blanking period. That is, the blanking unit discharges the parasitic capacitances in each row of the scanning lines in the LED array, and charges the parasitic capacitances in each column of the scanning lines in the LED array during the blanking period according to the blanking control signal.

The blanking period comprises a first period and a second period, the step S20 comprises specifically: the blanking unit outputs a first voltage to each of the columns of the scanning lines of the LED array during the first period; outputs a second voltage to each of the columns of the scanning lines of the LED array during the second period; the first voltage is higher than the second voltage. The second voltage is higher (i.e., larger) than a difference between the supply voltage and the conduct voltage of the LED lamp beads.

S30. Controls the brightness of the LED lamp beads during the PWM output period. That is, the constant current drive unit controls the brightness of the LED lamp beads during the PWM output period.

Due to both a principle and a feature of the drive method capable of eliminating the LED ghosts have been described in details in the embodiments above, thus no repeats are listed herein.

It should be understood that, the application of the present invention is not limited to the above examples listed. Ordinary technical personnel in this field can improve or change the applications according to the above descriptions, all of these improvements and transforms should belong to the scope of protection in the appended claims of the present invention.

What is claimed is:

1. A drive chip capable of eliminating a Light Emitting Diode (LED) ghost, comprising:

a processing circuit configured to divide a display cycle into a blanking period and a Pulse Width Modulation (PWM) output period, wherein the processing circuit is further configured to send a blanking control signal to a blanking circuit during the blanking period, and send a PWM signal to a constant current drive circuit according to display data during the PWM output period;

the blanking circuit configured to discharge a plurality of parasitic capacitances in each row of scanning lines in an LED array during the blanking period, and charge a plurality of parasitic capacitances in each column of the scanning lines in the LED array, according to the blanking control signal; and the constant current drive circuit configured to control a brightness of LED lamp beads of the LED array according to the PWM signal during the PWM output period, wherein:

the blanking period includes a first period and a second period, the first period being started before a row of scanning lines finishes scanning, and the second period being started after the row of scanning lines finishes scanning, and an output terminal of the blanking circuit is coupled to each column of the scanning lines of the LED array, and the blanking circuit is configured to output a first voltage to each column of the scanning lines during the first period and output a second voltage to each column of the scanning lines during the second period.

2. The drive chip according to claim 1, wherein the first voltage is higher than the second voltage.

3. The drive chip according to claim 2, wherein the second voltage is higher than a difference between a power source voltage and a conduct voltage of the LED lamp beads.

4. The drive chip capable according to claim 1, wherein the blanking period is a PWM output period gap between each pair of two lines in the LED array.

5. A drive circuit capable of eliminating the LED ghost comprising the drive chip according to claim 1, wherein the drive circuit further comprises:

a power source configured to supply power to the drive circuit;

the LED array including a plurality of the LED lamp beads;

a master a circuit configured to output the display data to the drive chip, and drive progressively each row of the scanning lines of the LED array through a switch circuit; and the switch circuit configured to control a switch between the rows of the scanning lines of the LED array and the power source, according to a control signal outputted from the master circuit.

6. The drive circuit according to claim 5, wherein the power source connects to the rows of the scanning lines of the LED array through the switch circuit, a row control terminal of the master circuit connects to a control signal input terminal of the switch circuit, a data output terminal of the master circuit connects to an input terminal of the drive chip, an output terminal of the drive chip connects to the columns of the scanning lines of the LED array.

7. The drive circuit according to claim 6, wherein the master circuit comprises:

a master sub-circuit configured to output the control signal to a code translation drive circuit, and output the display data to the drive chip;

the code translation drive circuit configured to translate the control signal, and control the switch circuit to drive a row of the scanning lines of the LED array according to a translated signal.

8. A drive method capable of eliminating a Light Emitting Diode (LED) ghost, comprising:

dividing a display cycle of an LED array into a blanking period and a Pulse Width Modulation (PWM) output period;

discharging a plurality of parasitic capacitances in each row of the scanning lines in the LED array, and charging a plurality of parasitic capacitances in each column of the scanning lines in the LED array during the blanking period;

controlling a brightness of LED lamp beads of the LED array during the PWM output period, wherein:

the blanking period includes a first period and a second period, the first period being started before a row of scanning lines finishes scanning, and the second period being started after the row of scanning lines finishes scanning, and the method further includes: outputting a first voltage to each column of the scanning lines during the first period and outputting a second voltage to each column of the scanning lines during the second period.

9. The drive method according to claim 8, wherein the first voltage is higher than the second voltage.

10. A drive chip capable of eliminating a Light Emitting Diode (LED) ghost, comprising:

a processing circuit configured to divide a display cycle into a blanking period and a Pulse Width Modulation (PWM) output period, wherein the processing circuit is further configured to send a blanking control signal to a blanking circuit during the blanking period, and send a PWM signal to a constant current drive circuit according to display data during the PWM output period;

the blanking circuit configured to discharge a plurality of parasitic capacitances in each row of scanning lines in an LED array during the blanking period, and charge a plurality of parasitic capacitances in each column of the scanning lines in the LED array, according to the blanking control signal; and the constant current drive circuit configured to control a brightness of LED lamp beads of the LED array according to the PWM signal during the PWM output period, wherein:

the blanking period includes a first period and a second period, an output terminal of the blanking circuit is coupled to each column of the scanning lines of the LED array, and the blanking circuit is configured to output a first voltage to each column of the scanning lines during the first period and output a second voltage to each column of the scanning lines during the second period, in response to the first voltage during the first period, parasitic capacitances of the LED lamp beads in a row of the scanning lines are discharged, and the parasitic capacitances in each column of the scanning lines in the LED array are charged, and in response to the second voltage during the second period, charges of the parasitic capacitances of the row line of the scanning lines are discharged to the parasitic capacitances of the LED lamp beads in the row.

* * * * *